US005431560A

United States Patent [19]

Helker et al.

[11] Patent Number: 5,431,560

[45] Date of Patent: Jul. 11, 1995

[54] DEVICE FOR SUPPLYING GAS TO A CYLINDRICAL ROTARY KILN

[75] Inventors: Heinrich Helker, Krefeld; Matthias Weis, Leverkusen, both of Germany

[73] Assignee: Bayer Aktiengesellschaft, Leverkusen, Germany

[21] Appl. No.: 319,347

[22] Filed: Oct. 6, 1994

[30] Foreign Application Priority Data

Oct. 13, 1993 [DE] Germany ..... 43 34 795.9

[51] Int. Cl.[6] ..... F27B 7/00; F27B 7/26

[52] U.S. Cl. ..... 432/103; 432/105; 432/113; 432/14; 34/135; 34/130; 34/499

[58] Field of Search ..... 432/14, 103, 105, 113; 34/130, 135, 499

[56] References Cited

U.S. PATENT DOCUMENTS

| | | | |
|---|---|---|---|
| 2,063,233 | 12/1936 | Debuch | 432/105 |
| 2,131,665 | 9/1938 | Jordan | 432/113 |
| 4,199,154 | 4/1980 | Mueller . | |
| 4,361,333 | 11/1982 | Firth . | |
| 4,930,965 | 6/1990 | Peterson et al. | 414/149 |

FOREIGN PATENT DOCUMENTS 1539335 1/1979 United Kingdom .

*Primary Examiner*—Henry A. Bennett
*Assistant Examiner*—Siddharth Ohri
*Attorney, Agent, or Firm*—Sprung Horn Kramer & Woods

[57] ABSTRACT

A device for supplying gas to a rotary cylinder by means of a slip ring channel is described, a relative movement between rotating part and stationary part of the slip ring being permitted.

3 Claims, 2 Drawing Sheets

DEVICE FOR SUPPLYING GAS TO A CYLINDRICAL ROTARY KILN

Figure 1:
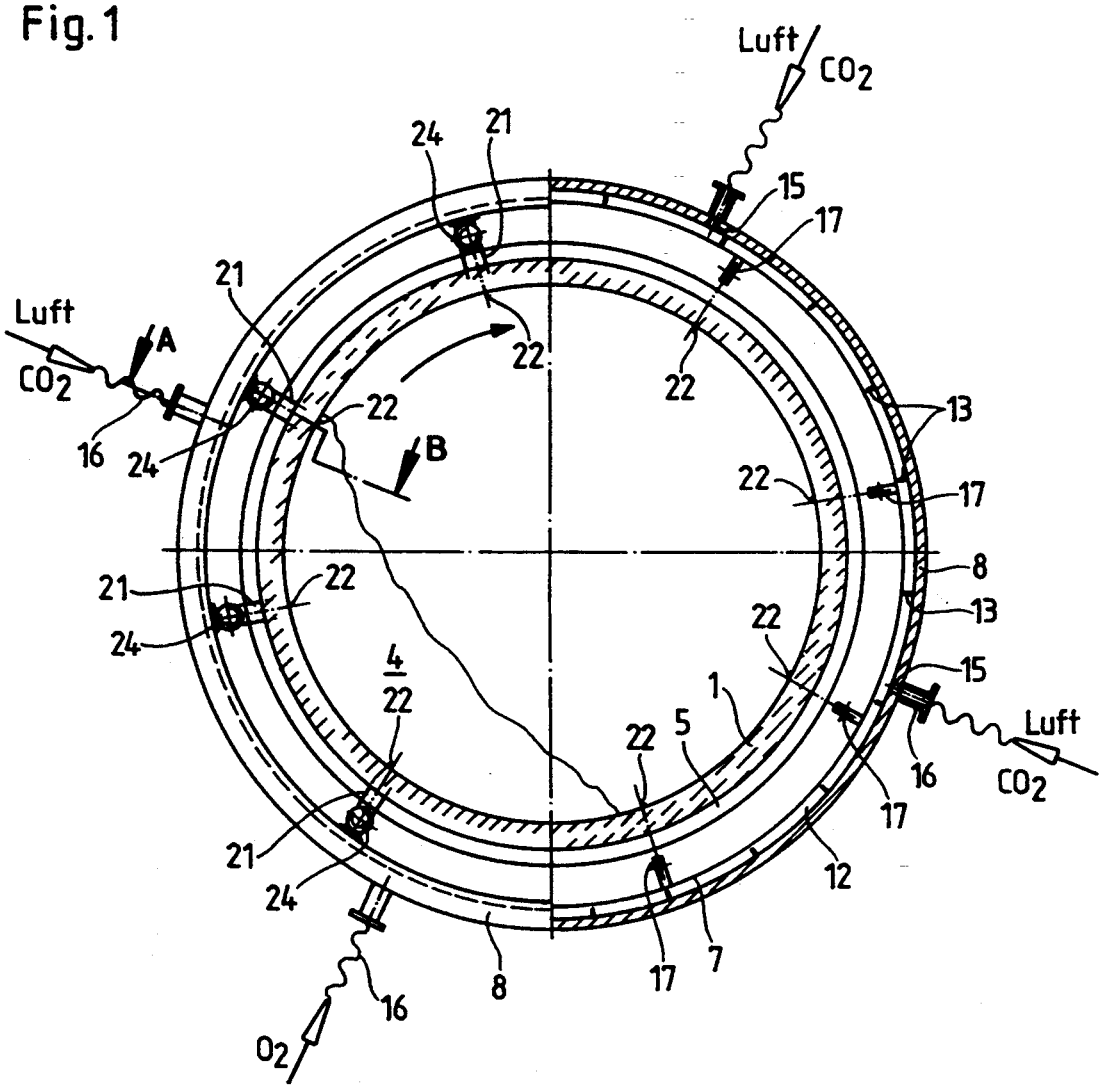

The invention relates to a device for supplying gas to a cylindrical rotary kiln, particularly the material to be calcined located in the cylindrical rotary kiln, the gas supply taking place through the rotary cylinder casing. In industry, rotary cylinders are used among other things to carry out solid/gas reactions at high temperatures, e.g. for the oxidizing treatment of ores. The ground ore is heated to the treatment temperature in the rotary cylinder and brought into contact at this temperature in the rotary cylinder with gases containing oxygen. The required residence time often depends on the intensity of the contact between the gas containing oxygen and the material to be calcined. Both the oxygen concentration in the rotary cylinder atmosphere and the ability of the oxygen to penetrate the rotary cylinder lining play a decisive part in this. With rotary cylinders heated directly by hot flame gases in particular it is barely possible to maintain an oxygen content in the kiln atmosphere which exceeds approximately 10%. There is therefore often the desire to inject the oxygen or other gases required for the reaction in the rotary cylinder directly through the rotary cylinder casing into the charge of material to be calcined. This involves the problem of supplying gases from a stationary source to the injection nozzles which are rotating with the rotary cylinder: casing about the rotary cylinder axis.

The object of the invention is a device for supplying gas to a cylindrical rotary kiln through gas supply nozzles arranged in at least one peripheral line of the rotary cylinder casing and passing through the rotary cylinder casing, which nozzles are supplied from essentially stationary gas supply lines which are not also rotating, which device is characterized by

- an annular disk concentric to the rotary cylinder axis and fixed on the outside on the periphery of the rotary cylinder casing,
- a conduit which is concentric to the rotary cylinder axis, U-shaped, open in the direction of the rotary cylinder axis and surrounds the disk on its outer periphery,
- on their inside the two legs of the conduit having grooves for receiving annular sealing elements which seal in a sliding manner against the lateral surface of the annular disk, forming an annular channel,
- the gas supply lines opening through the conduit into the annular channel and
- the annular disk having holes which connect the annular channel to the gas supply nozzles via gas pipes.

The invention accordingly relates to a specific embodiment of a slide ring channel. The problem with slide ring channels lies in the fact that generally speaking they do not allow sufficient play between moved and stationary part. In the course of operation, however, large industrial cylindrical rotary kilns of, for example, 30 to 50 m in length and a diameter of 3 to 5 m demonstrate substantial deviations of a few millimeters to centimeters from the strict rotationally symmetrical movement of a peripheral line. The device according to the invention permits both relative movements of the annular disk with respect to the conduit in the radial direction, i.e. perpendicular to the rotary cylinder axis, the seals sliding on the flat lateral surfaces of the disk in the radial direction, and a suspension of the conduit in such a way that it permits movements parallel to the rotary cylinder axis.

Figure 2:
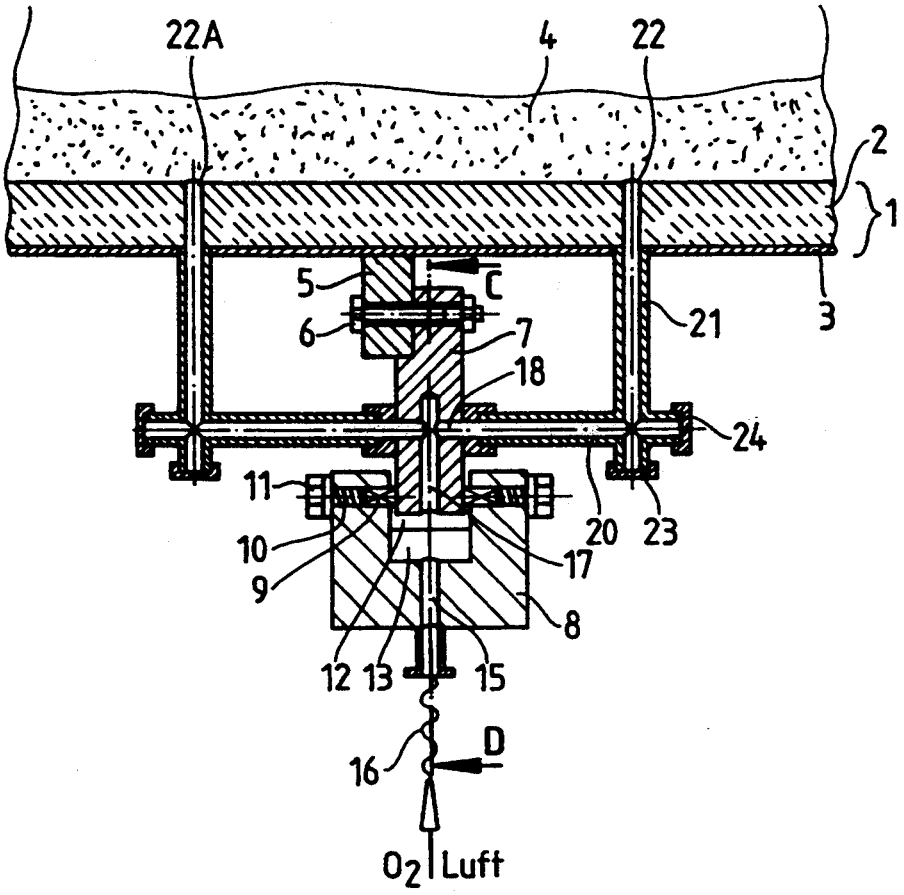
Figure 3:
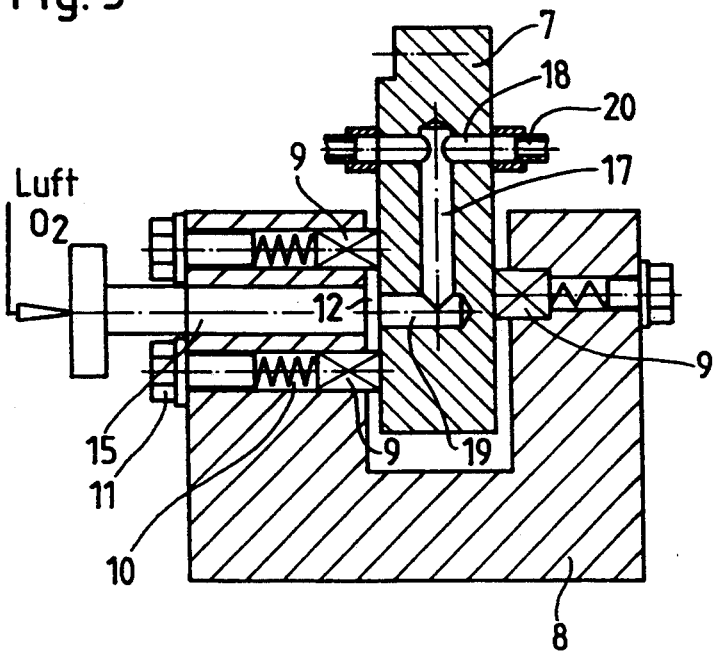

The invention will be described below with the aid of the accompanying drawings, in which:

FIG. 1 shows a view of the rotary cylinder and/or a cross-section through the rotary cylinder perpendicular to the rotary cylinder axis, FIG. 2 shows an enlarged section A–B through a plane which contains the rotary cylinder axis, FIG. 3 shows a partial view of an alternative embodiment in a view according to FIG. 2.

Unless otherwise stated, identical numbers in the drawings denote identical elements.

The rotary cylinder casing 1 typically comprises a lining 2 and a cladding 3. The charge of material to be calcined 4 is located in the rotary cylinder. The annular disk 7 is firmly connected to the rotary cylinder casing via bolts 6 and the bead 5 welded to the rotary cylinder cladding 3. The U-shaped conduit 8 concentric with the rotary cylinder axis and the disk 7 surrounds the outer part of the disk 7. On the inside of its legs the conduit 8 has grooves for receiving seals 9. The seals 9 seal in a slipping manner against the flat lateral surface of the disk 7. The contact pressure of the seals on the disk 7 can be adjusted via springs 10 and adjusting screws 11. The channel 12 formed between disk 7, conduit 8 and the seals 9 is supplied via at least one gas supply line 15, 16. Gas inlet nozzles 22 are also provided on at least one peripheral line parallel to the disk 7. Eight nozzles 22 are shown in FIG. 1 by way of example. Gas is supplied to the nozzles 22 via pipes 21,20 as well as holes 17, 18, 19 in the disk 7 from the channel 12. By way of example, FIG. 2 shows a second injection nozzle 22A which belongs to a row of nozzles which are arranged on a second peripheral line on the rotary cylinder casing. By extending the pipe 20 with corresponding further branches it is possible to supply further nozzles, which are arranged on a multiplicity of peripheral lines on the rotary cylinder casing, from the channel 12. On the opposite side to the branch point in each case, the branching of the pipes 20 and 21 has flanges 23, 24 which can be opened for the purpose of removing any blockages. Instead of the flange 23 a mechanism can advantageously be provided which regularly frees the pipe 21 and the nozzle 22 from material to be calcined which has penetrated them, e.g. whenever the rotary cylinder casing is not covered by material to be calcined 4. Furthermore, valves can be provided which interrupt the passage of gas whenever the rotary cylinder casing is not coated with material to be calcined, so that the injection of gas into the kiln atmosphere is prevented and only takes place when a charge is present. Alternatively, several gas supply lines 15, 16 (FIG. 1) to the channel 12 can be provided, different gases being supplied through the various supply lines. To prevent the mixing of the gases in the annular channel 12, plates 13 (FIG. 2) are then preferably provided which narrow the cross-section of the channel 12. In this way, for example, oxygen can be supplied in the gas supply line 16 located underneath the charge 4 and air or recycled combustion gases via the remaining supply lines, so that the supply nozzles covered with material to be calcined essentially convey oxygen and the nozzles 22 not covered with material to be calcined essentially convey air and/or carbon dioxide.

The embodiment according to FIG. 3 with a laterally arranged annular channel 12 is particularly appropriate when different gases are to be introduced via the periphery of the annular channel. As the annular channel does not change its dimension through relative movements of disk 7 and conduit 8 it is possible to insert sealing blocks to separate the annular channel into several sections instead of the plates 13 (FIG. 2). Stringent demands should not be placed on the seals, so that the contact pressure on the disk 7 can be kept lower than that of the sealing rings 9.

We claim:

1. Device for supplying gas to a cylindrical rotary kiln through gas supply nozzles (22) arranged in at least one peripheral line of the rotary cylinder casing (1) and passing through the rotary cylinder casing, which nozzles are supplied from essentially stationary gas supply lines (16) which are not also rotating, characterized by a) a disk (7) concentric to the rotary cylinder axis and fixed on the outside on the periphery of the rotary cylinder casing (1), b) a U-shaped, concentric conduit (8) surrounding the disk on its outer periphery, c) on their inside the two legs of the conduit (8) having grooves for receiving annular sealing elements (9) which seal in a sliding manner against the lateral surface of the disk (7), forming an annular channel (12), d) the gas supply lines (16) opening through the conduit (8) into the annular channel (12) and e) the disk (7) having holes (17), (18), (19) which connect the gas supply nozzles (22) to the annular channel (12) via gas pipes (20), (21).

2. Device according to claim 1, characterized in that the conduit (8) has several gas supply lines (16, 15) distributed over the periphery for introducing different gases and plates (13) are arranged in the annular channel as flow obstacles and/or seals to prevent the mixing of the various gases.

3. Device according to claim 1, characterized in that the conduit (8) is mounted in such a way that a movement parallel to the rotary cylinder axis is possible.

* * * * *